US009702668B2

(12) United States Patent
Peterson et al.

(10) Patent No.: US 9,702,668 B2
(45) Date of Patent: Jul. 11, 2017

(54) LINEAR SHAPED CHARGE

(71) Applicant: National Technology & Engineering Solutions of Sandia, LLC, Albuquerque, NM (US)

(72) Inventors: David Peterson, Albuquerque, NM (US); Jerome H. Stofleth, Albuquerque, NM (US); W. Venner Saul, Los Lunas, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 14/870,934

(22) Filed: Sep. 30, 2015

(65) Prior Publication Data

US 2016/0202027 A1 Jul. 14, 2016

Related U.S. Application Data

(60) Provisional application No. 62/101,254, filed on Jan. 8, 2015.

(51) Int. Cl.

*F42B 1/028* (2006.01)
*F42B 1/032* (2006.01)
*F42B 1/036* (2006.01)

(52) U.S. Cl.

CPC ..... *F42B 1/028* (2013.01); *F42B 1/032* (2013.01); *F42B 1/036* (2013.01)

(58) Field of Classification Search

CPC .. F42B 1/02; F42B 1/028; F42B 1/032; F42B 1/036; F42B 3/08; F42B 12/10

USPC ..... 102/306, 307, 308, 309, 310, 476

See application file for complete search history.

(56) References Cited

U.S. PATENT DOCUMENTS

| | | | | |
|---|---|---|---|---|
| 4,222,329 | A * | 9/1980 | Austin | F42B 1/02 102/305 |
| 4,628,819 | A * | 12/1986 | Backofen, Jr. | F42B 3/28 102/303 |
| 4,693,181 | A | 9/1987 | Dadley et al. | |
| 4,982,665 | A | 1/1991 | Sewell et al. | |
| 5,333,550 | A * | 8/1994 | Rodney | F42B 3/28 102/275.8 |
| 5,415,101 | A | 5/1995 | Brinkmann | |
| 6,378,438 | B1 | 4/2002 | Lussier et al. | |
| 8,006,621 | B1 * | 8/2011 | Cherry | B26F 3/04 102/307 |
| 8,146,503 | B2 | 4/2012 | Murray et al. | |
| 9,194,667 | B2 * | 11/2015 | Chartier | C06C 5/04 |
| 2009/0078144 | A1 | 3/2009 | Behrmann et al. | |

(Continued)

FOREIGN PATENT DOCUMENTS

| | | | | |
|---|---|---|---|---|
| CZ | EP 1635133 A2 * | 3/2006 | | F42B 1/02 |
| DE | 3834491 A1 * | 4/1990 | | F42B 1/02 |

*Primary Examiner* — James S Bergin

(74) *Attorney, Agent, or Firm* — Medley, Behrens & Lewis LLC

(57) ABSTRACT

Linear shaped charges are described herein. In a general embodiment, the linear shaped charge has an explosive with an elongated arrowhead-shaped profile. The linear shaped charge also has and an elongated v-shaped liner that is inset into a recess of the explosive. Another linear shaped charge includes an explosive that is shaped as a star-shaped prism. Liners are inset into crevices of the explosive, where the explosive acts as a tamper.

7 Claims, 5 Drawing Sheets

(56) References Cited

U.S. PATENT DOCUMENTS

| | | | | |
|---|---|---|---|---|
| 2010/0018427 | A1* | 1/2010 | Roland | F41H 11/11<br>102/305 |
| 2013/0014662 | A1 | 1/2013 | Lumley | |
| 2015/0040789 | A1* | 2/2015 | McDonald | F42B 1/02<br>102/307 |

* cited by examiner

LINEAR SHAPED CHARGE

RELATED APPLICATION

This application claims priority to U.S. Provisional Patent Application No. 62/101,254, filed on Jan. 8, 2015, and entitled "LINEAR SHAPED CHARGE", the entirety of which is incorporated by reference.

STATEMENT OF GOVERNMENTAL INTEREST

This invention was developed under Contract DE-AC04-94AL85000 between Sandia Corporation and the U.S. Department of Energy. The U.S. Government has certain rights in this invention.

BACKGROUND

Linear shaped charge (LSC) design has been static fir several decades. Design of conventional LSCs has been based on trial and error, and is primarily based on geometry of existing conical shaped charges (CSCs) or from modified mild detonating fuze (MDF) cross sections. With more particularity, an exemplary design of a conventional LSC is based upon a cross-sectional profile of a CSC, where such profile is extruded linearly.

FIG. 8 illustrates a conventional LSC 800. The LSC 800 comprises a casing 802 and an explosive 804. The LSC 800 is shaped as an extruded hexagon with two faces inverted inwards as a "V" to create a collapse plane. Typically the casing 802 is made from a single piece of tube stock that is passed through a roller die to reach the proper geometry for an interior liner 806 and an exterior "tamper" 808 of equal thickness due to both being made of the same sheath material. The explosive 802 can be cast at a later time or explosive powder can be already placed within the tubing during rolling such that it is pressed to the correct density during the processing As shown, the sides of the liner 806 that form a first apex are in parallel with the sides of the explosive 804 that form a second apex. In other words, an apex angle of the explosive 804 is equivalent to an apex angle of the liner 806.

In operation, the LSC 800 is positioned adjacent to a target, such that the recessed side of the explosive 804 faces the target. The explosive 804 is detonated, resulting in the collapse of the v-shaped liner 806 forming a planar jet emitted towards a target, where the jet is emitted in a plane that extends through the apex of the explosive 804 and the apex of the liner 806. The jet comprises the liner 806, wherein the liner 806 has been compressed and stretched in accordance with the Monroe Affect due to shock forces caused by detonation of the explosive 804. The jet impacts the target and hydrodynamically penetrates or "cuts" through the target to a particular penetrating depth (wherein the penetrating depth is dependent upon numerous factors).

SUMMARY

Linear shaped charges (LSC) are described herein. In a general embodiment, the present disclosure provides an LSC having an explosive, such as RDX, HMX, PBX-9501 or similar that has both a high detonation velocity and small critical diameter. Combined with other geometry features, an exemplary LSC described herein obtains deeper penetration into a target material when compared to a conventional LSC, while comprising a same amount for less) explosive when compared to a conventional LSC.

In another embodiment, an LSC can include a tamper that is formed as a prism, such as a rectangular or square prism or any shape that appears monolithic to initial explosive shock during device detonation. The tamper can be composed of a relatively dense material, such as steal, lead, a dense plastic, etc. In an exemplary embodiment, the tamper can be of sufficient size to allow for the tamper to be modeled as an infinitely heavy backing tamper in the infinitely tamped sandwich equation (Gurney equation).

The tamper includes an elongated v-shaped recess on the front face of the tamper that extends along a length of the tamper. The LSC also includes an explosive that is inset into the recess of the tamper, such that the explosive is formed as an isosceles triangular prism. Thus, the explosive has a pair of isosceles triangular bases and three sides that extend between the bases.

The explosive includes an elongated v-shaped recess on a front face of the explosive that extends along a length of the explosive. Accordingly, an apex of the explosive extends in parallel with an apex of the elongated v-shaped recess of the explosive. In contrast to conventional designs, an apex angle of the explosive is smaller than an apex angle of the v-shaped recess of the explosive.

The LSC also includes an elongated v-shaped liner that extends the length of the explosive, wherein the elongated v-shaped liner is inset into the elongated v-shaped recess of the explosive. The design of the exemplary LSC differs from conventional LSCs, in that an amount of explosive perpendicularly adjacent to sides of the v-shaped liner continuously tapers from the apex of the liner towards its edges. Experimentally, this design has been found to have a significant increase in performance relative to conventional designs.

In yet another embodiment, the present disclosure provides an LSC that is configured to simultaneously emit multiple jets in different planes. The exemplary LSC includes an explosive formed as a star-shaped prism, wherein bases of the star-shaped prism are designed based upon patterning a cross-sectional profile of the explosive described above about a central axis. Accordingly, the explosive has a pair of star-shaped bases and a plurality of sides that extend between the pair of star-shaped bases. In an example, the star-shaped bases can have six points, and accordingly, the explosive can have 12 sides. The LSC also includes an elongated v-shaped liner that is inset in the explosive, such that the liner is in contact with at least two intersecting sides of the explosive. In this exemplary embodiment, the explosive can act as both a propellant and a tamper.

Additional features and advantages are described herein, and will be apparent from the following Detailed Description and the figures.

DETAILED DESCRIPTION

Figure 1:
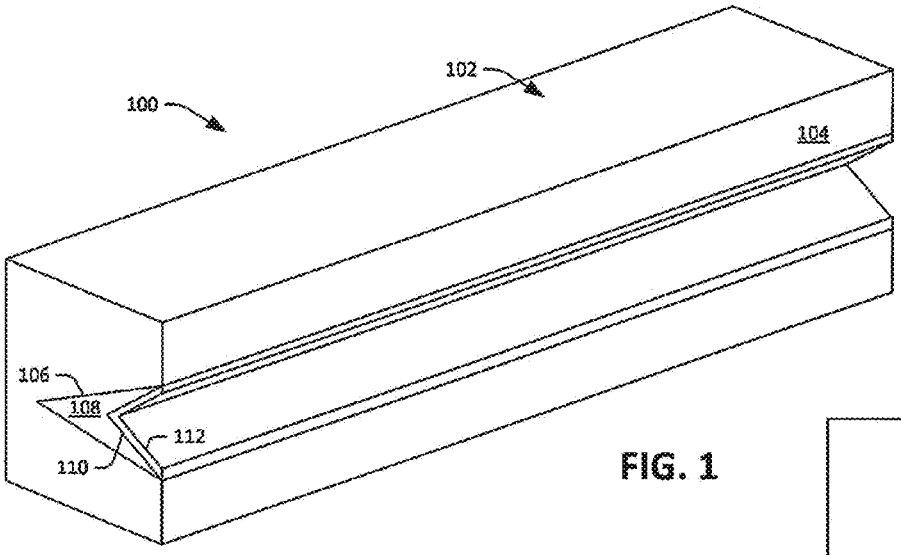
FIG. 1 is an isometric view of an exemplary linear shaped charge (LSC).
Figure 2:
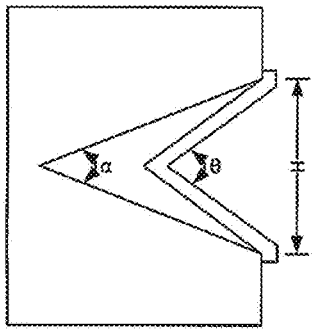
FIG. 2 is a cross-sectional view of the exemplary LSC shown in FIG. 1.

Linear shaped charges (LSCs) are disclosed herein. With reference to FIGS. 1 and 2, a linear shaped charge (LSC) 100 in a general embodiment of the present disclosure is illustrated. FIG. 1 is an isometric view of the LSC 100, and FIG. 2 is a cross-sectional view of the LSC 100. The exemplary LSC 100 includes a tamper 102, which can be composed of a relatively dense material, such as lead, steal, a dense plastic, or the like. As shown, the tamper 102 may be in the shape of a prism, such as a rectangular or square prism. Accordingly, the tamper 102 has a pair of bases in parallel with one another and a plurality of sides that extend between respective edges of the bases. The tamper 102 has a front face 104 that extends between edges of the bases of the tamper 102. The tamper 102 comprises a v-shaped recess 106 from the front face 104 of the tamper 102 that extends along the length of the front face 104 of the tamper 102 (and thus along the length of the LSC 100). Lengths of sides of the recess 106 can be approximately equivalent.

The LSC also comprises an explosive 108 that is inset into the recess 106 of the tamper 102. Thus, the explosive 108 can be shaped as an (recessed) isosceles triangular prism that extends the length of the tamper 102. In an example, the explosive 108 can be RDX (such as C4) or some other suitable explosive. The explosive 108 has a front face that is coplanar with the front face 104 of the tamper 102. Additionally, the explosive 108 can have an elongated v-shaped recess 110 from the front face of the explosive 108. The elongated v-shaped recess 110 can extend along a length of the front face of the explosive 108, such that it extends the entirety of the length of the LSC 100. A plane (not shown) that extends through the apex of the recess 106 and the apex of the recess 110 bifurcates the LSC 100, such that the LSC 100 is symmetric about such plane.

The LSC 100 also comprises an elongated v-shaped liner 112 that is inset into the recess 110 of the explosive 108. As shown in FIG. 1, the v-shaped liner 112 can extend along a length of the recess 110 of the explosive 108. Pursuant to an example, the v-shaped liner 112 can be composed of relatively pure, annealed copper. For example, the v-shaped liner 112 can be between 99% and 100% copper.

The explosive 108 has a first apex angle $\alpha$, while the elongated v-shaped liner 112 has a second apex angle $\theta$. In a non-limiting example, the second apex angle $\theta$ can be between 40 degrees and 90 degrees. In the LSC 100, the first apex angle $\alpha$ is smaller than the second apex angle $\theta$. Thus, in contrast with conventional LSC designs, an amount of the explosive 208 that is proximate the v-shaped liner 112 continuously tapers from an apex of the v-shaped liner 112 to its edges. Therefore, as shown in FIG. 2, a profile of the cross-section of the LSC 100 is formed as an arrow-head shape.

Additional detail pertaining to the LSC 100 is now provided. With respect to the tamper 102, the tamper 102 may be of sufficient size relative to the explosive 118 to allow for the tamper 102 to be modeled as an infinitely heavy backing tamper in the infinitely tamped sandwich equation (Gurney equation). Experimentally, when size of the tamper 102 is enhanced as noted above, an increase in penetration attributable to such size enhancement is 10% to 15% relative to conventional LSCs.

With respect to the liner 112, in conventional LSCs, traditional copper tube stock has been used as liners. Material properties in such tube stock, however, can vary greatly, and oftentimes such copper is not in an annealed state. In simulations, use of a high purity (e.g., 99% to 100%) annealed copper was found to significantly enhance the penetrating ability of the LSC 100. Further, conventional LSCs comprise liners that are relatively thick (e.g., greater than 6% of the height H of the front face of the explosive 108). In the LSC 100, a thickness of the v-shaped liner 112 can be approximately 4% of the height H of the front face of the explosive 108. For instance, the thickness of the v-shaped liner 112 can be between 3.5% and 5% the height H of the front face of the explosive 108.

Figure 8:
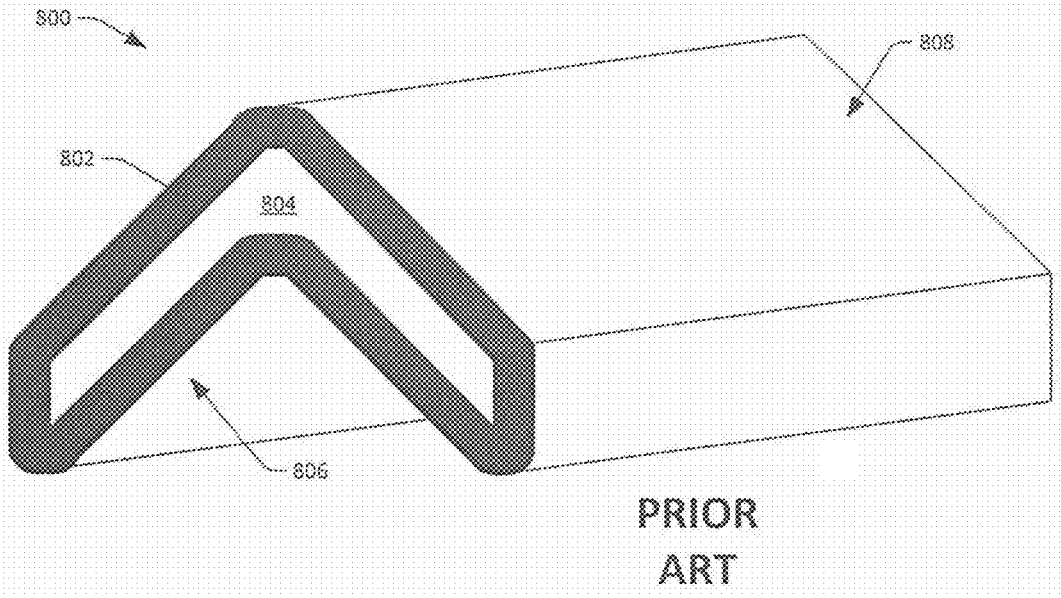
PRIOR ART FIG. 8
FIG. 8 is an isometric view of a conventional LSC.

Operation of the LSC 100 is now described. The explosive 108 is detonated through use of a detonator (not shown). Shock force produced by detonation of the explosive 108 simultaneously compresses the liner 112 and propels the liner 112 along the plane that extends through the apex of the recess 106 and the apex of the recess 110. Thus, a planar jet (which may also be referred to as a blade) is emitted, where the jet has a velocity over a length of the jet along the collapse plane, resulting in stretching of the jet over time until the jet particulates. As jet velocity and stretching increases, depth of penetration of the jet into a target likewise increases. Experimentally, the LSC 100, when the explosive was a 1200 grain per foot explosive, was found to emit a jet with a tip velocity of 4-4.5 km/s. For sake of comparison, a conventional LSC having the same 1200 grain per foot explosive emits a jet with a tip velocity of between 1.5 and 3 km/s. Therefore, the LSC 100 exhibits a significant increase in performance over conventional LSCs (such as that shown in FIG. 8).

Further, experimentally it has been shown that the LSC 100 emits a jet of greater length when compared to conventional LSCs (when having the 1200 grain per foot of explosive). For example, the LSC 100 exhibits a relatively large M/C gradient from the apex of the v-shaped liner 112 to its edges (e.g., the front face 104 of the tamper 102), where M is the mass of a tamper and C is the mass of explosive per unit length of charge. Typically this ratio is almost fixed along the cross-sectional profile of the charge; however, in the LSC 100 the ratio at the apex is relatively low but rises to near infinite near the tips of the charge. As M/C decreases, speed of the liner is increased. Thus, the liner thrown near the apex of the charge, which makes up the resulting jet tip, travels faster than the material that trails behind it in the jet from the tips of the LSC 100 with a higher M/C ratio. As mentioned above, this corresponds to a jet tip speed that is increased relative to jet tip speeds of conventional LSCs, as well as increased jet length relative to jet lengths of conventional LSCs. Therefore, in the LSC 100, less of the explosive 108 can result in deeper penetration.

Figure 3:
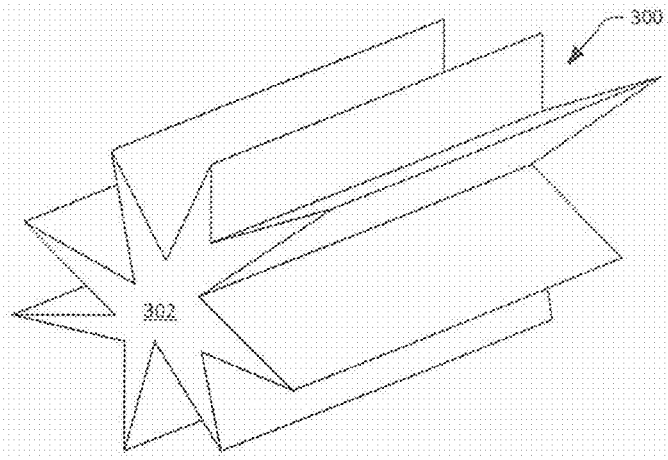
FIG. 3 is an isometric view of another exemplary LSC.
Figure 4:
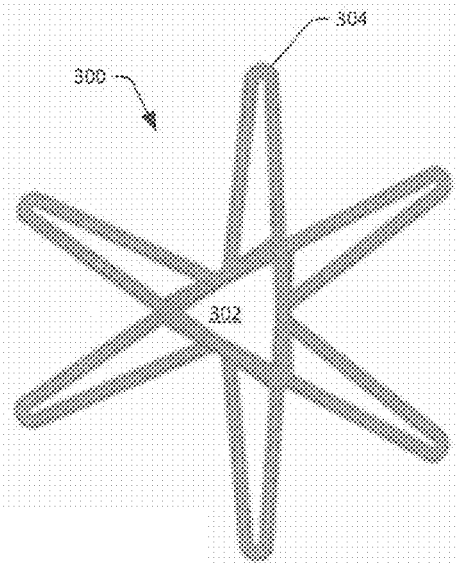
FIGS. 4 and 5 are cross-sectional views of the exemplary LSC shown in FIG. 3.
Figure 5:
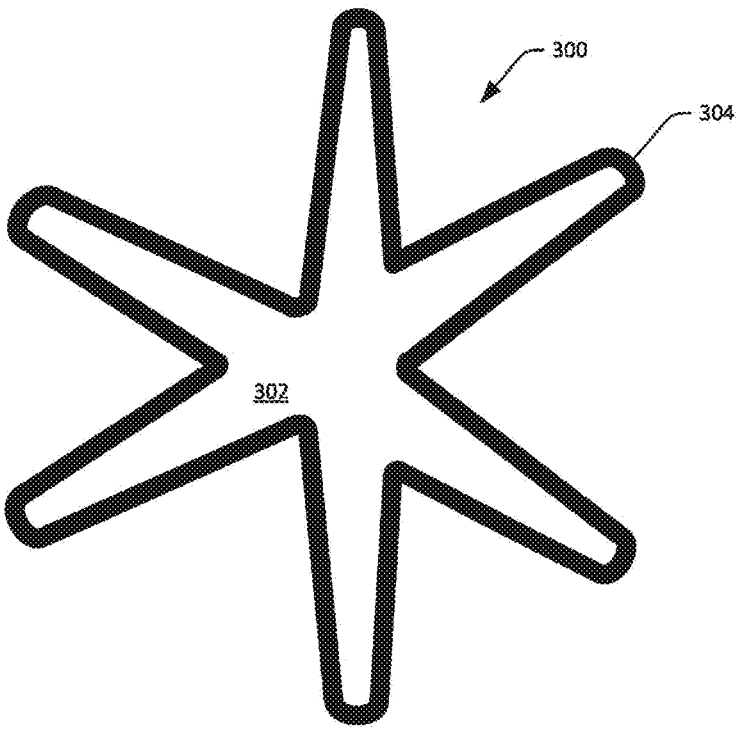

Turning now to FIGS. 3-5, another exemplary LSC 300 is illustrated. With more particularity, FIG. 3 is an isometric view of the LSC 300, and FIGS. 4 and 5 are cross-sectional views of the LSC 300.

The exemplary LSC 300 comprises an explosive 302 that is shaped as a star-shaped prism, such that the explosive 302 has a pair of star-shaped bases and a plurality of sides that extend between respective edges of the pair of star-shaped bases. The explosive 302 can be composed of any suitable explosive, such as an RDX-based explosive (e.g., C4). The LSC 300 further comprises at least one v-shaped liner (not shown) that is inset into an elongated v formed by intersecting sides of the explosive 302. That is, the v-shaped liner is in contact with at least two intersecting sides of the plurality of sizes of the explosive 302.

As shown in FIGS. 4 and 5, the LSC 300 can include a liner 304 that is placed in contact with all sides of the explosive 302. In other words, the liner 304 can be wrapped around the explosive 302. In other examples, the LSC 300 can include a plurality of v-shaped liners inset at multiple v-shaped insets of the explosive 302. It can be ascertained that a jet can be emitted from each v-shaped inset of the explosive.

In the exemplary LSC 300, bases of the explosive 302 have six points and twelve edges. Accordingly, the explosive 302 has two bases and twelve sides. It is to be understood, however, that the explosive 302 may have more or fewer than twelve sides.

In an exemplary embodiment, a profile of the cross-section of the explosive 302 can be based upon the profile of the cross-section of the explosive 108 of the LSC 100. As noted above, the explosive 108 has an arrowhead-shaped cross-sectional profile. A base of the explosive 302 can be designed by patterning the arrowhead cross-sectional profile of the explosive 108 multiple times around a central axis, wherein the arrowhead cross-sectional profiles partially overlap with one another. FIG. 4 illustrates the cross-sectional profile of the explosive 108 patterned in triplicate about a central axis, where bifurcating axes of the arrowhead profiles are offset from one another by 120 degrees. FIG. 5 depicts the resultant cross-sectional profile of the explosive 302.

The LSC 300 can further include one or more tampers that are inset into insets of the explosive 302. For instance, tampers can be placed in every other crevice formed by intersecting sides of the explosive 302. The tampers can be formed of relatively dense metals, such as lead, steel, a plastic or the like.

Operation of the LSC 300 is now described. The explosive 302 is detonated through use of a detonator (not shown). Shock forces produced by the detonating explosives serve at least two purposes: 1) to form jets that are emitted from the LSC 300; and 2) to provide tamping. For the formation of multiple jets, this results in reduction of overall net explosive weight (when compared to using three LSCs such as that the LSC 800 shown in FIG. 8). Self-tamping through use of explosive also reduces need for passive tamping. High-density polyethylene (HDPE) or other suitable plastic can be placed in secondary crevices to prevent secondary jet formation (which may otherwise be difficult to mitigate). In simulation, the LSC 300 has been demonstrated as having 42%-57% better penetration into a target than three (independent) conventional 1200 grain per foot charges, while having at least 40% less explosive than conventional charges. Further, tip velocity of jets emitted from the LSC 300 were simulated as being on the order of 4 km/s.

Figure 6:
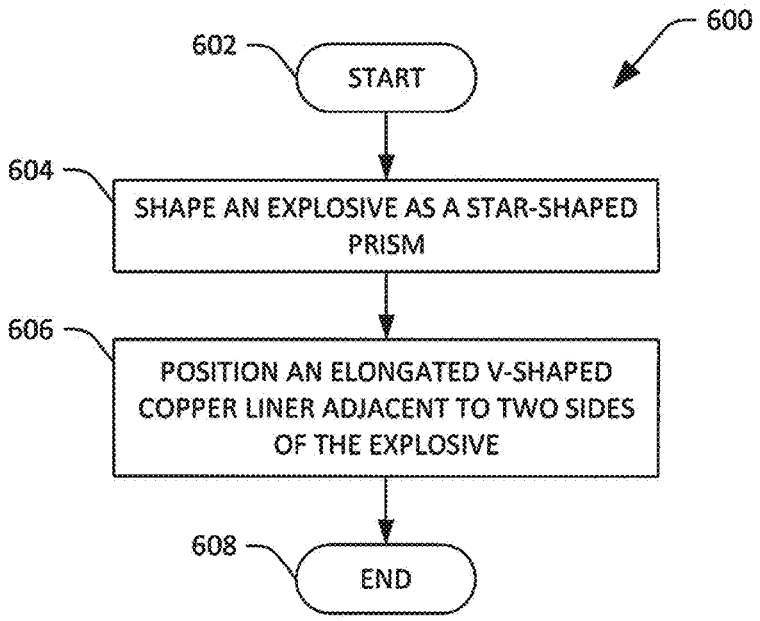
FIG. 6 is a flow diagram illustrating an exemplary methodology for creating an LSC.
Figure 7:
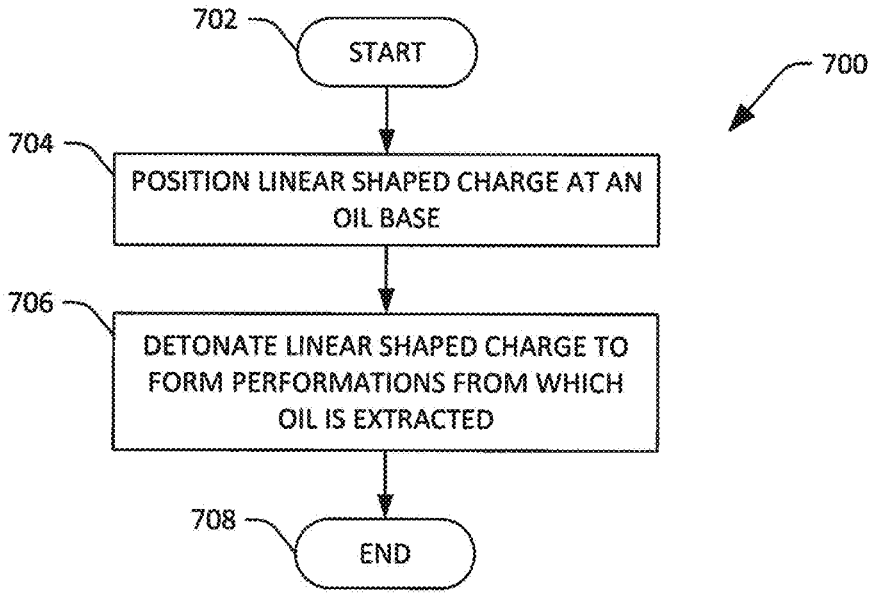
FIG. 7 is a flow diagram illustrating an exemplary methodology for using an LSC.

FIGS. 6-7 illustrate exemplary methodologies relating to linear shaped charges. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

With reference to FIG. 6, an exemplary methodology 600 for creating an LSC is illustrated. The methodology 600 starts at 602, and at 604, an explosive is shaped as a star-shaped prism. Accordingly, the explosive has a pair of star-shaped bases and a plurality of sides that extend between edges of the star-shaped bases. At 606, an elongated v-shaped copper liner is positioned adjacent to two sides of the explosive, such that the v-shaped copper liner forms a planar jet when the explosive is detonated. As indicated above, multiple v-shaped liners can be positioned at multiple crevices of the explosive, such that multiple jets are emitted. The methodology 600 completes at 608.

Now referring to FIG. 7, an exemplary methodology 700 for use of an LSC is illustrated. The methodology 700 starts at 702, and at 704, an LSC is positioned at a location where oil is to be extruded (a base). The LSC can have a design such as the LSC 100 or the LSC 300. At 706, the LSC is detonated to form perforations in the base from which oil is extracted. The methodology 700 completes at 708. While the methodology 700 describes one exemplary application of the LSC 100 and/or the 300, other applications are contemplated. For example, the LSC 100 and/or the LSC 300 can be used in aerospace applications, demolition applications, mining applications, and the like. Further, the LSC 300 can be employed in an explosive destruct system (EDS) vessel where munitions can be attacked around a central axis. Other applications are also contemplated.

As used herein, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference, and the term "about" refers to a range of 10% of the value to which the term applies.

All patents, patent applications, publications, technical and/or scholarly articles, and other references cited or referred to herein are in their entirety incorporated herein by reference to the extent allowed by law. The discussion of those references is intended merely to summarize the assertions made therein. No admission is made that any such patents, patent applications, publications or references, or any portion thereof, are relevant, material, or prior art. The right to challenge the accuracy and pertinence of any assertion of such patents, patent applications, publications, and other references as relevant, material, or prior art is specifically reserved.

In the description above, for the purposes of explanation, numerous specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated among the figures to indicate corresponding or analogous elements, which may optionally have similar characteristics.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

It should also be appreciated that reference throughout this specification to "one embodiment", "an embodiment", "one or more embodiments", or "different embodiments", for example, means that a particular feature may be included in the practice of the invention. Similarly, it should be appreciated that in the description various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the Wowing claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

What is claimed is:

1. A linear shaped charge comprising:

an explosive formed as an isosceles triangular prism that comprises an elongated v-shaped recess that extends along a front face of the explosive of the linear shaped charge, the explosive having an apex angle, a height of the front face is based upon the apex angle; and an elongated v-shaped liner inset into the v-shaped recess of the explosive, the elongated v-shaped liner having an apex angle that is greater than the apex angle of the explosive, the v-shaped liner has a thickness, the thickness of the v-shaped liner is between 3.5% and 5% of the height of the front face of the explosive.

2. The linear shaped charge of claim 1, the elongated v-shaped liner formed of annealed copper.

3. The linear shaped charge of claim 2, the annealed copper having a purity of between 99% and 100%.

4. The linear shaped charge of claim 1, the apex angle of the elongated v-shaped liner is between 40 degrees and 90 degrees.

5. The linear shaped charge of claim 1, further comprising a tamper shaped as a prism that comprises a recess that extends along a length of a face of the tamper, the explosive inset into the recess of the tamper.

6. The linear shaped charge of claim 5, the tamper comprises lead or steel.

7. The linear shaped charge of claim 5, the prism being a rectangular prism.

* * * * *